United States Patent [19]

David

[11] 4,003,678

[45] Jan. 18, 1977

[54] FLUID OPERATED WELL TURBOPUMP

[75] Inventor: Ed B. David, Benton, Ark.

[73] Assignee: E M C Energies, Inc., Casper, Wyo.

[22] Filed: Feb. 10, 1975

[21] Appl. No.: 548,860

[52] U.S. Cl. ..... 417/88; 417/91; 417/405; 417/408

[51] Int. Cl.[2] ..... F04B 23/04

[58] Field of Search ..... 417/405, 88, 91, 406, 417/408

[56] References Cited

UNITED STATES PATENTS

| | | | |
|---|---|---|---|
| 1,063,294 | 6/1913 | Seaver, Jr. | 417/88 |
| 1,170,163 | 2/1916 | Kieser | 417/88 |
| 1,610,454 | 12/1926 | Lawaczek | 417/406 |
| 1,818,455 | 8/1931 | Bigelow | 417/88 |
| 1,992,436 | 2/1935 | McMahon | 417/76 |
| 2,164,975 | 7/1939 | Whitcomb | 417/91 |
| 2,726,606 | 12/1955 | Davidson | 417/408 |
| 2,733,663 | 2/1956 | Marshall | 417/406 |
| 3,143,078 | 8/1964 | Gaslow et al. | 417/406 |
| 3,171,355 | 3/1965 | Harris et al. | 417/406 |
| 3,758,238 | 9/1973 | Erickson et al. | 417/408 |
| 3,788,771 | 1/1974 | Akins | 417/91 |

FOREIGN PATENTS OR APPLICATIONS

| | | | |
|---|---|---|---|
| 319,305 | 10/1918 | Germany | 417/88 |

*Primary Examiner*—C. J. Husar
*Attorney, Agent, or Firm*—Ralph R. Pittman

[57] ABSTRACT

A fluid operated turbopump, suitable for use in an oil well pumping system, is structurally adapted as either a hydraulically insertable and removable unit or as a permanent attachment to a bottom hole tubing. The turbopump has axially spaced rotary driving and driven impellers operable for overbalancing columns of fluid which are separated by the well tubing wall, the overbalancing operation facilitating upward movement of fluid from a production zone to above ground storage. A tubular drive shaft which interconnects the impellers is utilized to convey fluid axially through one of the impellers.

9 Claims, 13 Drawing Figures

FLUID OPERATED WELL TURBOPUMP

BACKGROUND

A large variety of fluid operated pumps, some of which embody axially spaced driving turbine and driven pump impellers, have been described in the prior art, those pumps suitable for bottom hole operation usually requiring somewhat complex mechanical structures. In general, the complexity of these mechanisms is found in the structures utilized to secure the moving pump members within the necessarily limited tubing size, while at the same time finding room for the fluid passageways needed for moving fluid upwardly through or around the pump members. More particularly, the fluid passageways are often so located and of such configuration as to impede, rather than to facilitiate the upward movement of fluid from a production zone.

SUMMARY OF THE INVENTION

The turbopump described herein has a hydraulically operated driving turbine axially spaced from a driven pump, each having a single impeller, the impellers being rigidly mechanically joined by an axially extending drive shaft. The turbopump is constructed for running into an oil well while attached to the bottom end of a tubing string, or alternately for pumping down into or up out of the tubing string.

A bypass structure in the turbopump assures that the driving fluid, which may be crude oil, is not mingled with pumped production fluid within the driving turbine. A coaxial bore through a portion of the revoluble drive shaft is employed as a conduit in the bypass structure, inwardly directed fluid openings through the conduit wall of the shaft are contoured to so deflect the inwardly moving fluid from a radial direction as to augment the turning moment of the driving impeller. Similarly, the entrance ports for conducting driving fluid from the outside of the driving turbine housing to impinge upon the driving impeller are also oriented to direct the driving fluid to the turbine blades at the angle to yield the maximum torque under the prevailing conditions of volume and pressure.

A jet-venturi structure is positioned at the discharge end of the turbopump. At this location the spent driving fluid is discharged from the turbine casing through a jet nozzle into the throat of a coaxially disposed venturi tube. A pair of sloped production fluid passageways in the structure concurrently direct production fluid into the throat of the venturi, the spent driving fluid and the pumped production fluid mixing at this location, the blend exiting via the end bell of the venturi. The fluid driven out of the jet nozzle reacts with the venturi to effect a lowering of the head against which the production fluid moves, assisting the bottom hole pressure in moving fluid upwardly through the turbopump while reducing the head against which the driven pump impeller works.

The turbopump is adapted for service as an insert or "free" turbopump and sized for hydraulic installation and removal without pulling the tubing. For this service, a turbopump-receiving chamber is added at the bottom end of the associated tubing, a check valve added at the upper end of the turbopump, and the turbopump oriented to discharge downwardly and into an annular space between the well casing and the tubing.

DESCRIPTION OF THE PREFERRED EMBODIMENT

The invention is a hydraulically operated turbopump adapted for positioning in a production zone at the lower end of an oil well tubing string. Both the tubing and an annular space between the tubing and the well casing are utilized as passageways for fluid movement. The turbopump is suitable for either (1) a first operating procedure in which the pump-actuating fluid pumped from accessory surface facilities moves downwardly along the annular space and the pumped production fluid, along with the spent driving fluid, moves upwardly through the tubing, as shown in FIGS. 1 and 11; or alternately (2) a second operating procedure in which the pump-actuating fluid moves from the surface downwardly through the tubing, the pumped production fluid along with the spent driving fluid moving upwardly through the annular space, as shown in FIGS. 2 and 12.

Figure 1:
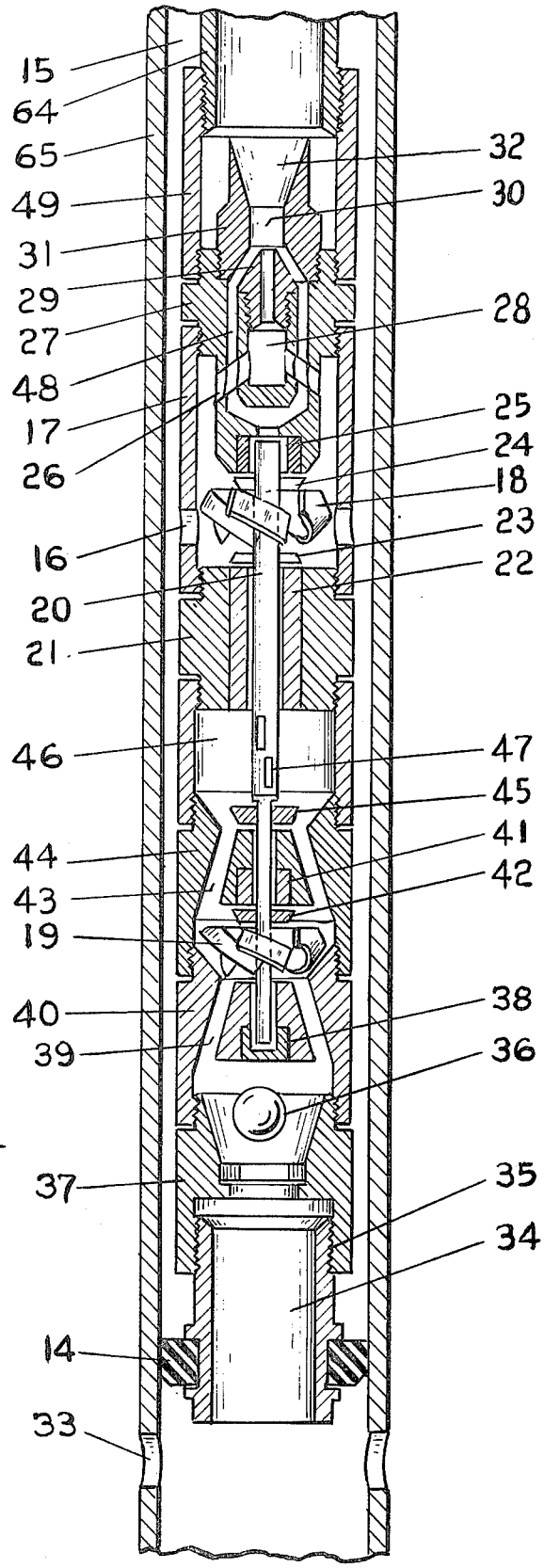
FIG. 1 is an elevation, principally in section except for a diagrammatic view of the bypass member 27, of a turbine driven pump assembly embodying the invention and illustrating an installation within a typical oil well casing. The driving fluid actuating the turbopump moves downwardly through an annular space between the casing and the tubing, and a blend of production and spent driving fluid moves upwardly through the tubing.
Figure 2:
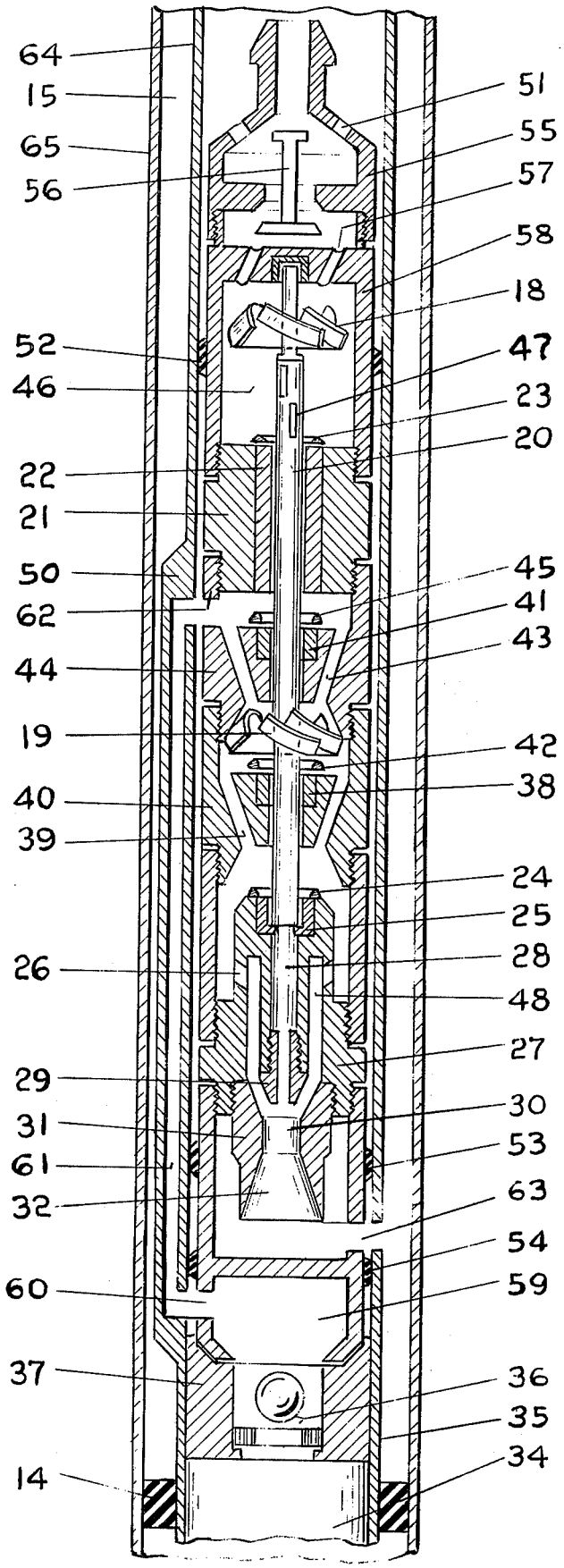
FIG. 2 is a similar view, in which the turbopump assembly is removably disposed within a bottom hole chamber in an inverted position with respect to that of FIG. 1, the driving fluid moving downwardly through the tubing and the blend of spent driving fluid and production fluid moving upwardly in an annular space between the tubing and the casing.
Figure 13:
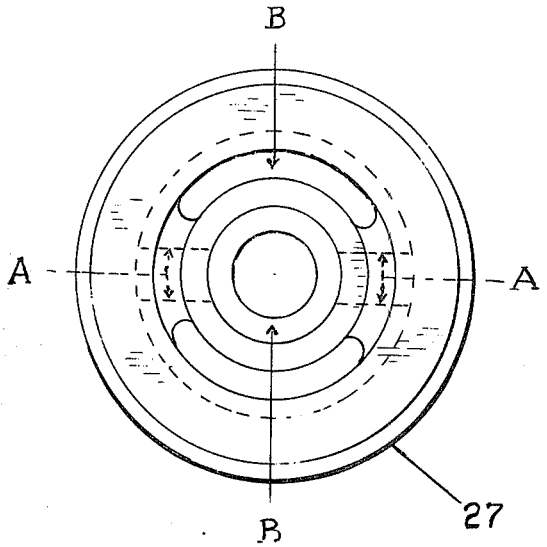
FIG. 13 is a plan view of the bypass member shown in section at FIG. 4, as mentioned above in connection with the latter figure.
Figure 3:
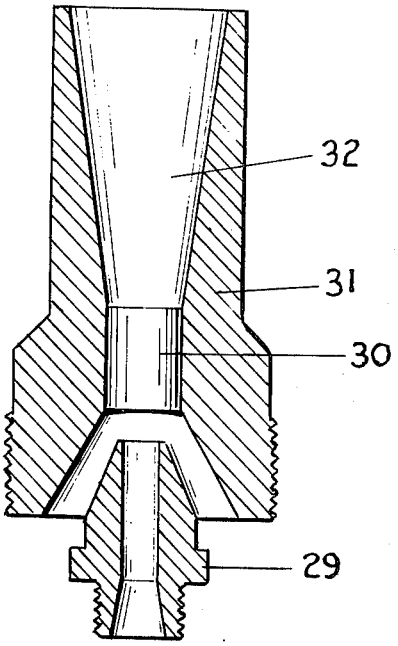
FIG. 3 is a fragmentary sectional view illustrating the venturi tube and the associated jet nozzle construction utilized at the discharge end of the turbopump.
Figure 4:
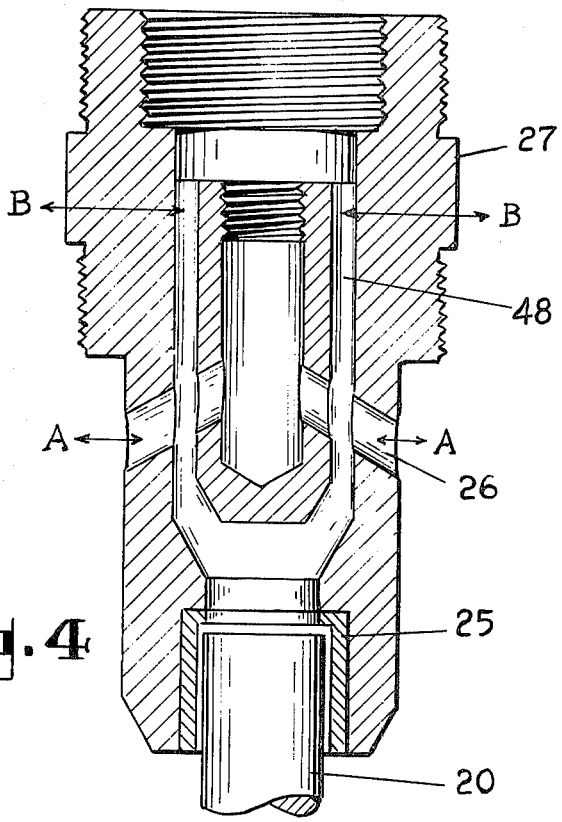
FIG. 4 is a fragmentary diagrammatic view, principally in section, of the fluid bypass member, the accompanying plan diagram being for the purpose of showing the absence of any connection between the vertical and transversely extending passageways.
Figure 11:
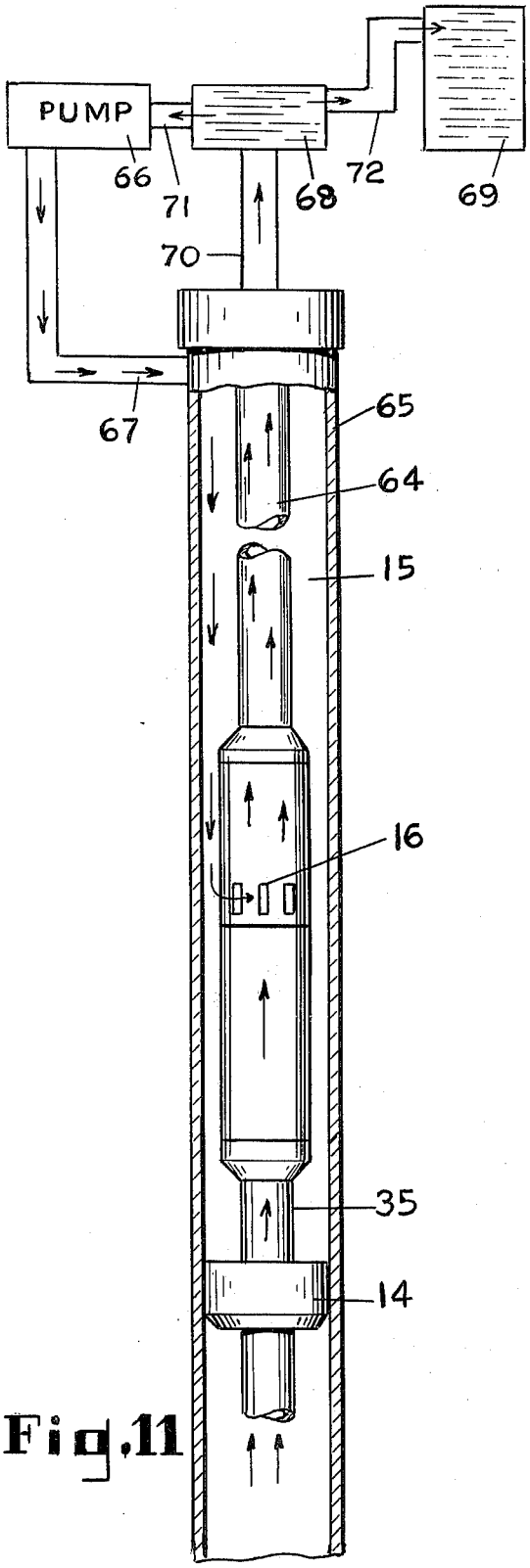
FIG. 11 is a diagrammatic elevation of the turbopump of FIG. 1, indicating direction of fluid movement and associated surface facilities.
Figure 12:
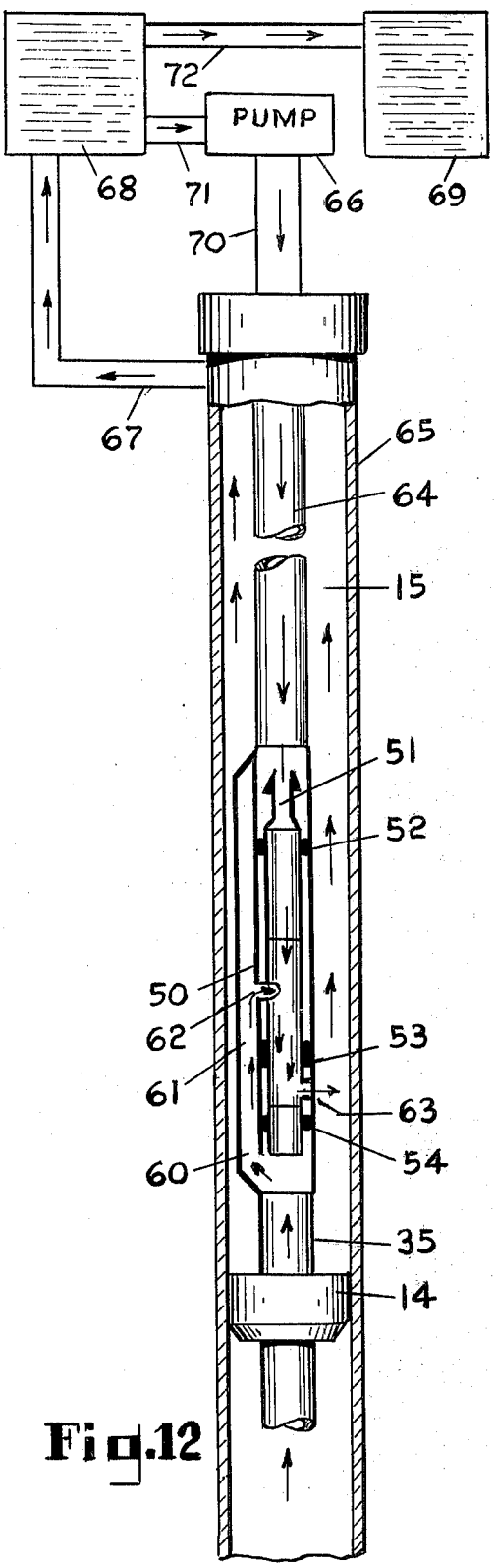
FIG. 12 is a similar view showing the differing fluid movement when the turbopump operates when it is removably fitted in the casing as in FIG. 2.

Referring first to FIGS. 1 and 11 of the drawing, the well casing 65 contains the coextending tubing 64 within the annular space 15, a lower end portion of the tubing threadedly joining the upper bypass mixing and aggregating member 27 of the turbopump by means of the top tubing connector 49. As shown in more detail in FIGS. 3 and 4, the venturi 31, including the throat 30 and the belled exit 32, threadedly connects to the internal threads at the upper end of the bypass 27. The member 27 has formed therein a pair of laterally disposed, downwardly extending passageways 48 (noted as "B" in FIG. 4) and a pair of separated, diametrically opposed, transversely sloped ports 26 (noted "A" in FIG. 4), and the discharge nozzle 29 extends in spaced coaxial relation with the venturi 31, being threadedly connected to convey fluid from the collecting chamber 28 of the bypass member 27.

Figure 5:
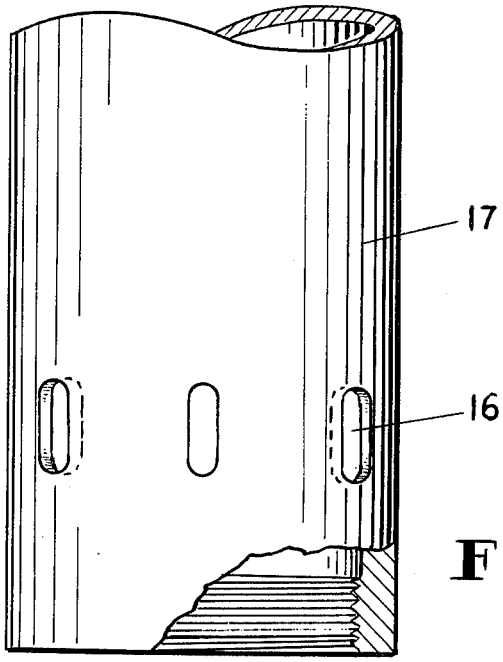
FIG. 5 is a fragmentary elevational view of the turbine housing embodied in the assembly shown in FIG. 1, showing the slotted openings for directing the driving fluid along the desired angle of impingement with the driving turbine impeller.
Figure 6:
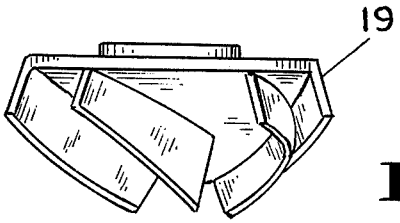
FIG. 6 is an elevational view of the driven pump impeller.

The impeller 18 of the upper and driving centrifugal turbine is mounted for rotation within the housing 17, the latter being threadedly attached at its upper end to a lower end portion of the bypass member 27 and at its lower end to the upper end of the main bearing housing 21. A plurality of fluid-directing slots 16 are circumferentially spaced around the turbine housing 17, shown in more detail in FIG. 5.

The impeller 18 is rigidly secured to the coaxially extending shaft 20, and the latter is journaled both in the upper turbine bearing 25 at the lower end of the bypass member 27 and in the main bearing 22. The tapered thrust bearings 24 and 23 also function as sand shields for the upper bearing 25 and the main bearing 22.

A production-receiving chamber 46 is connected at its upper end to the lower end of the main bearing housing 21, and at its lower end to the upper bowl 44 of the lower and driven centrifugal pump member. The main drive shaft 20 mechanically connects the upper and driving impeller 18 to the lower and driven impeller 19, the drive shaft extending sequentially downward through the tapered thrust bearing and sand shield 45, the bearing 41 of the driven pump member, the tapered thrust bearing and sand shield 42 and the impeller 19, the drive shaft terminating in the lower pump bearing 38.

Figure 8:
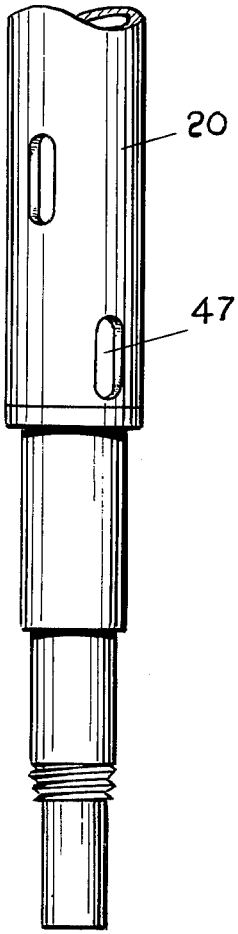
FIG. 8 is a fragmentary view of the drive shaft which connects the driving turbine to the driven pump, showing the fluid-directing passageways through the wall of the hollow portion of the drive shaft.
Figure 10:
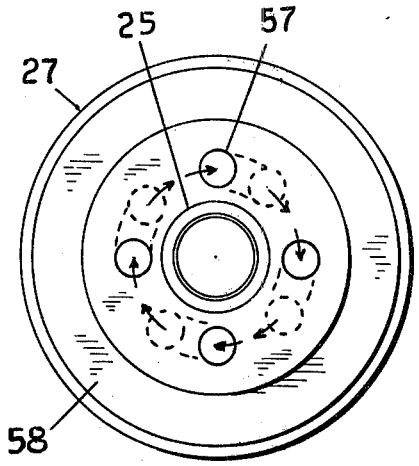
FIG. 10 is a plan view of the housing of the upper and driving turbine, showing the directional ports through the top of the housing.
Figure 9:
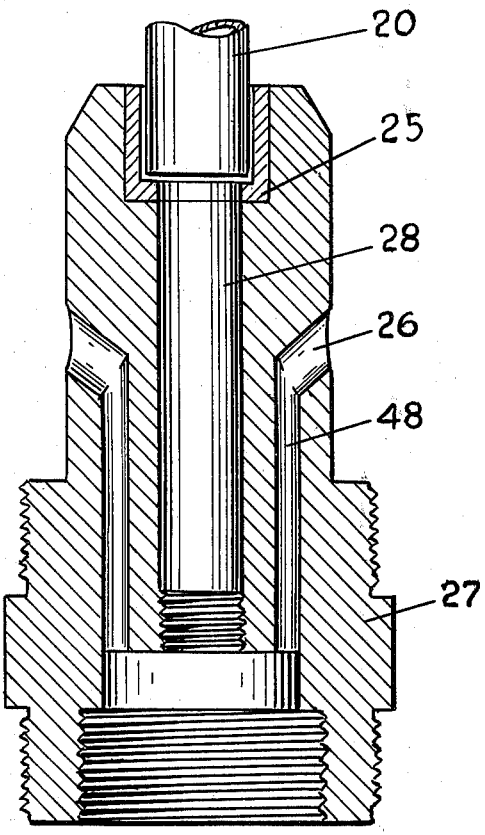
FIG. 9 is a sectional elevation of the fluid-aggregating bypass mixing member forming a portion of the discharge path from the lower and driven pump in FIG. 2.

The portion of the drive shaft 20 which extends below the production-receiving chamber 46 is solid in section; the remaining portion is larger in diameter and tubular in section, having an axial bore therethrough. The fluid-directing slots 47, shown in more detail in FIG. 8, provide contoured openings for directing the movement of fluid from the chamber 46 to the hollow portion of the shaft so as to effect a turning moment thereof. The upper open end of the drive shaft communicates with the production fluid passageways 48.

Figure 7:
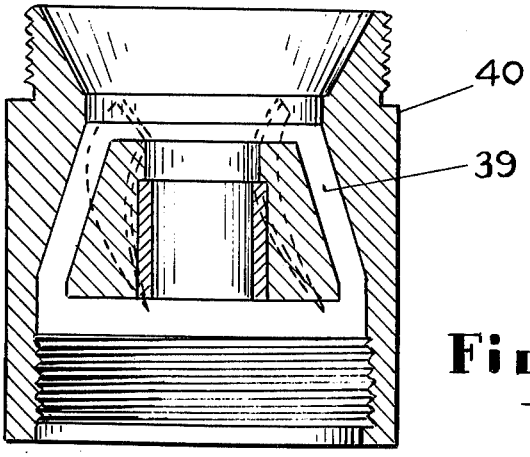
FIG. 7 is a sectional view of the lower bowl of the driven pump.

The lower bowl 40, shown enlarged at FIG. 7, is threadedly secured at its lower end of the end to the upper bowl 44, extending coaxially downward therefrom to threaded engagement with the upper end portion of the standing valve 37, the ball 36 of the valve being movable between open and closed positions. The channels 39 direct fluid from the valve 37 to the impeller 19 and the discharge channels 43 direct fluid through the bowl 44 from the impeller 19 to the production-receiving chamber 46.

In accordance with common practice, a production packer 34 is threadedly secured to the lower end portion of the valve 37, the packing ring retainer 35 extending downwardly to secure the annular resilient sealer 14 in a position to seal the annular space against entrance of production fluid into the annular space 15 from the casing perforations 33.

In the diagrammatic elevation at FIG. 11, the arrows indicate the direction of movement of fluid under producing conditions with the well turbopump shown in FIG. 1. Before starting the power supply pump 66, a driving fluid, e.g., crude oil, is moved downwardly through the discharge flow pipeline 70 from the driving fluid storage tank 68, filling the tubing string 64 and the annular space 15 between the tubing 64 and the casing 65. Leakage from the assembly is prevented by the production packer sealer 14 and the standing valve 37.

Upon starting the pump 66, driving fluid is drawn from the tank 68 through the pump suction pipeline 71 and discharged from the pump through the pipeline 67 into the annular space 15. Since the latter is sealed at the lower end by the production packer, the driving fluid is driven through the fluid-directing slots 16 of the turbine casing 17 and thereby to engagement with the impeller 18 at the angle to effect maximum impeller torque available from the momentum of the moving fluid. The only available exit path for the fluid passing through the turbine housing 17 is upward through the bypass ports 26 to the collection chamber 28, and thence sequentially upward through the jet nozzle 29 and the venturi 31.

The lower driven pump impeller 19 rotates concurrently with the driving turbine impeller 18, the movement of the driving fluid and the lower impeller drawing production fluid into the casing through the perforations 33 and upwardly through the standing valve 37 into the bowl 40 of the lower driven pump.

From the lower bowl 40 of the lower driven pump the production fluid is lifted through the channels 39 and the channels 43 of the pump bowl 44 to fill the intermediate production-receiving chamber 46. From the chamber 46 the production fluid enters the bore of the hollow portion of the drive shaft 20 through the fluid-directing slots 47, and thence is driven axially upward through the driving impeller 18 into the transversely spaced, longitudinally extending passageways 48. At the upper end of the bypass member 27 the production fluid is directed into the converging upper portions of the passageways 48 and thence into the throat 30 of the venturi 31, at which point it is commingled with the spent driving fluid moving out of the jet nozzle 29.

The mixture of spent circulating driving fluid and production fluid is finally driven upward into the tubing string 64, the discharge pipeline 70 and the driving fluid storage tank 68. Such pumped production fluid as is not recirculated from the tank is delivered to the production storage tank via the pipeline 72.

The turbopump as modified for placement as a tubing insert, i.e., a structure suitable for pumping down through the tubing string to the bottom of a well, as well as adapted for being pumped back to the surface, is shown in FIGS. 1 and 12. For this application, the turbopump is inverted as compared to its disposition in FIG. 1, certain members added, omitted or modified, and as is common in free standing pumps, an enlarged bottom hole turbopump receiving compartment 50 is secured to the tubing along the lower end portion thereof.

The bottom hole assembly also includes a modified ball valve body, rigidly fixed to the inside of the tubing, on which the turbopump is rested in the operating position, the housing 17 of FIG. 1 has been replaced by the housing 58, the top tubing connector 49 omitted, and the upper, intermediate and lower annular seals 52, 53 and 54 respectively added. A check valve chamber 55 and the associated disk member 56 at the upper end of the turbine housing 58 replaces the bypass member 27 of FIG. 1, the housing 58 having an upper end closure through which the contoured fluid-directing ports 57 extend.

The assembled turbopump along with the longitudinally spaced resilient seals 52, 53 and 54, is first inserted into the upper end of the tubing and then hydraulically driven down in the tubing by pumping fluid above the turbopump until it seats on the ball valve body 37. To remove the turbopump, fluid is pumped into the annular space 15, entering the lower end of the assembled turbopump through the port 63, the upward movement of the fluid through the turbopump effecting closure of the check valve disk 56 and the hydraulic pressure lifting the turbopump upward through the tubing.

For normal pumping operation the annular space 15 and the tubing 64 are filled with driving fluid, these columns of liquid being hydraulically balanced. The introduction of additional driving fluid through the pipeline 70 into the tubing from the pump 66 effects rotation of the impellers 18 and 19 and the delivery of production fluid from the production zone to the surface.

During operation the driving fluid enters the top of the turbopump through the upper ports 51 in the check valve chamber 55, the annular resilient seal 52 blocking the passage of driving fluid below the seal in the space between the driving turbine housing 58 and the inner surface of the tubing 64. The driving fluid in the valve chamber 55 moves the check valve disk 56 to the open position, permitting the driving fluid to move through and thereby be directionally oriented by the ports 57, the fluid impacting the upper turbine impeller blades in the direction to yield the maximum torque available from the driving fluid delivery.

The spent driving fluid moving from the impeller 18 leaves the intermediate chamber 46 through the contoured slots 47 and into the bore of the lower and hollow portion of the shaft 20. The slots 47 are shaped to direct the moving fluid into the shaft at an angle with a radius to add an increment of turning moment to the shaft in the direction it is rotated by the reaction of the driving fluid on the impeller 18. After passage downward through the bore of the shaft the spent driving fluid moves into the inner chamber 28 of the bypass aggregating member 27. The spent driving fluid is then jetted through the restricted jet nozzle 29 into the throat 30 of the venturi 31, and from the venturi through the port 63 to the annular space 15, the seals 53 and 54 precluding entrance of the downstream driving fluid to the space between the turbopump and the tubing from which it is suspended.

The production packer sealing ring 14 prevents the entrance of production fluid into the annular space 15, and in response to the overbalancing of the hydraulic head therein production fluid moves upward through the ball valve 37 into the production chamber 59, thence outwardly through the lower port 60, upwardly through the bypass channel 61 and inwardly through the port 62 to the upper bowl 44 of the driven pump.

The inlet channels 43 in the upper bowl 44 direct the production fluid to the lower impeller 19, and the production fluid is driven by the impeller 19 downward through the discharge channels 39 in the lower pump bowl 40, the tapered thrust bearing 24 shielding the bearing 25 against entrance of production sand. The discharge channels 39 communicate with the sloping bypass ports 26, which direct the production fluid downward through the bypass passageways 48 to commingle with the spent driving fluid discharging from the jet nozzle 29 within the throat 30 of the aggregating venturi 31. The blend of production and spent driving fluid exits from the pump through the discharge orifice 63 to the annular space 15, and thence upwardly to the surface tanks 68 and 69.

What is claimed is:

1. A fluid operated oil well turbopump adapted for connection to the bottom hole end of the tubing of an oil well and for operation by means of pressurized driving fluid circulating from an above-ground source through a path which includes the tubing and an annular space between the tubing and a casing of the well, said turbopump comprising:

an upper driving turbine and an axially spaced lower driven pump, each including a housing containing a revoluble impeller, a drive shaft extending coaxially through each of said impellers, said drive shaft having a solid portion secured to the pump impeller and a coextensive tubular portion secured to and extending beyond the turbine impeller, the solid portion merging with the tubular portion at a junction located between said impellers, said tubular portion being closed at the junction end and open at the other end and having a plurality of peripherally spaced intake openings extending through the wall of said tubular portion at a location spatially adjacent to said junction, the bore of said tubular portion defining a production fluid conduit extending through said turbine impeller from the intake openings to the open outlet end thereof, a production fluid inlet at the lower end of said pump, a production fluid intake channel effective for directing production fluid from said inlet to said pump impeller, a production fluid discharge channel extending upwardly from said pump impeller to the connection of the turbopump to said well tubing above said turbine impeller, said discharge channel including the tubular portion of said drive shaft, circumferentially spaced slotted driving fluid inlet openings in said turbine housing effective for directing pressurized fluid from said annular space to impingement on said turbine impeller, and a spent driving fluid passageway in communication with said turbine housing effective for directing spent driving fluid upwardly into said well tubing.

2. The pump as claimed in claim 1 including a coaxially disposed venturi mounted in spaced relation with the discharge end of said tubular portion of said shaft and a jet nozzle mounted between said discharge opening and said venturi, said jet nozzle being axially directed to the throat of said venturi.

3. The well pump in accordance with claim 2, including means defining a fluid path extending from the outlet end of said shaft to the throat of said venturi, said fluid path including a pair of opposed longitudinally extending channels communicating with said jet nozzle only within the throat of said venturi.

4. The pump as defined in claim 1, wherein the opposed sides of said intake openings are disposed in planes subtending segments of the circle defining the circumference of said shaft.

5. The turbopump according to claim 1, wherein the opposed sides of each of said circumferentially spaced slotted openings in the housing containing the turbine impeller lie in planes subtending segments of the circle of rotation of said impeller.

6. In a fluid operated oil well pumping system for use in an oil well having an outer tubular casing set in the well, an inner tubing radially spaced from said casing to provide an annular passageway therebetween, and a turbopump disposed within said casing at the lower end of said tubing, said turbopump comprising:

an upper driving turbine including a housing and a housed impeller, a lower driven pump impeller and a drive shaft mechanically connecting said impellers, said drive shaft having a solid end portion passing downward through said lower pump impeller and an open end tubular portion passing upwardly through said upper turbine impeller, a production fluid inlet at the lower end of said pump, driving fluid intake openings in said housing adjacent to said turbine impeller for delivering driving fluid thereto from said annular passageway, a spent fluid passageway above said turbine impeller for delivering spent fluid upwardly into said inner tubing, a production fluid intake for delivering production fluid to said pump impeller from said inlet and a production fluid discharge channel extending upwardly from said pump impeller and upwardly through said turbine impeller into said inner tubing, said production fluid discharge channel including a plurality of peripherally spaced openings into the tubular portion of said drive shaft.

7. The pumping system as claimed in claim 6, wherein said spent fluid passageway above said turbine impeller includes a jet nozzle and a serially related venturi mounted between the open end of said drive shaft and said inner tubing, and said production fluid discharge channel includes passages terminating at the throat of said venturi.

8. In a fluid operated oil well turbopump:

a centrifugal turbine including a cylindrical housing, a revoluble impeller journaled for effecting axial flow of driving fluid from within said housing, a centrifugal pump disposed in coaxial relationship downward from said turbine, a drive shaft having a tubular portion, said drive shaft axially interconnecting said turbine and said pump, a plurality of circumferentially spaced inwardly directed openings in the wall of said turbine housing, an upwardly directed jet nozzle carried by said turbine housing, at least one channel connecting said jet nozzle to the interior of the turbine housing in position to receive spent driving fluid moving upwardly from said impeller, a venturi associated with said jet nozzle, said venturi being mounted in spaced coaxial alignment with said jet nozzle, a production fluid inlet at the lower end of said pump, and a production fluid passageway from said inlet to the throat of said venturi, said production fluid passageway including a segment positioned to bypass said turbine impeller.

9. The turbopump as claimed in claim 8, wherein the production fluid passageway from inlet to venturi includes the tubular portion of said drive shaft.

* * * * *